US011145455B2

(12) United States Patent
Chen et al.

(10) Patent No.: US 11,145,455 B2
(45) Date of Patent: Oct. 12, 2021

(54) TRANSFORMER AND AN ASSOCIATED METHOD THEREOF

(71) Applicant: GENERAL ELECTRIC COMPANY, Schenectady, NY (US)

(72) Inventors: Qin Chen, Beverly, MA (US); Dale Mashtare, Greenville, SC (US); Philip Cioffi, Niskayuna, NY (US); Jovan Bebic, Schenectady, NY (US); Ravisekhar Raju, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 431 days.

(21) Appl. No.: 16/036,967

(22) Filed: Jul. 17, 2018

(65) Prior Publication Data

US 2020/0027651 A1 Jan. 23, 2020

(51) Int. Cl.

| | |
|---|---|
| ***H01F 27/24*** | (2006.01) |
| ***H01F 27/32*** | (2006.01) |
| ***H01F 41/12*** | (2006.01) |

(52) U.S. Cl.

CPC ..... *H01F 27/324* (2013.01); *H01F 27/24* (2013.01); *H01F 27/323* (2013.01); *H01F 27/327* (2013.01); *H01F 41/125* (2013.01); *H01F 41/127* (2013.01)

(58) Field of Classification Search

CPC ..... H01F 27/306; H01F 27/263

USPC ..... 336/212

See application file for complete search history.

(56) References Cited

U.S. PATENT DOCUMENTS

| | | | | |
|---|---|---|---|---|
| 4,095,206 | A * | 6/1978 | Hishiki | H01F 27/022 336/178 |
| 6,407,339 | B1 | 6/2002 | Rice et al. | |
| 8,545,977 | B2 | 10/2013 | Clifford et al. | |
| 9,190,205 | B2 | 11/2015 | Outten et al. | |
| 2004/0085784 | A1 | 5/2004 | Salama et al. | |
| 2008/0143465 | A1 | 6/2008 | Tan et al. | |
| 2008/0245644 | A1 | 10/2008 | Meier et al. | |

(Continued)

FOREIGN PATENT DOCUMENTS

WO 2014177268 A1 11/2014

OTHER PUBLICATIONS

Leijon et al., "A Recent Development in the Electrical Insulation systems of Generators and Transformers", IEEE Electrical Insulation Magazine, http://ieeexplore.ieee.org/abstract/document/925298/, vol. 17, Issue 3, pp. 10-15, May-Jun. 2001.

(Continued)

*Primary Examiner* — Ronald Hinson

(74) *Attorney, Agent, or Firm* — Wood IP LLC

(57) ABSTRACT

A transformer having an insulation system is presented. The transformer includes a magnetic core having an opening. Also, the transformer includes a plurality of primary windings disposed extending through the opening of the magnetic core. Further, the insulation system includes a first insulation substantially encapsulating the plurality of primary windings and impregnating spaces between the plurality of primary windings, and a second insulation disposed around the first insulation, where the second insulation has at least one of a predetermined dielectric strength and a predetermined thickness configured to isolate a first voltage signal in the plurality of primary windings from the magnetic core.

23 Claims, 8 Drawing Sheets

(56) References Cited

U.S. PATENT DOCUMENTS

| | | | | |
|---|---|---|---|---|
| 2009/0015094 | A1* | 1/2009 | Yoshitake | H02K 15/12 310/257 |
| 2009/0066290 | A1* | 3/2009 | Altekruse | B60L 53/302 320/108 |
| 2014/0320256 | A1* | 10/2014 | Inaba | H01F 37/00 336/221 |

OTHER PUBLICATIONS

Lothar, "An Actively Cooled High Power, High Frequency Transformer with High Insulation Capability", Seventeenth Annual IEEE Applied Power Electronics Conference and Exposition (APEC), vol. 1, pp. 352-357, 2002.

Yin et al., "Dielectric Breakdown of Polymeric Insulations Aged at High Temperatures", Proceedings of the IEEE International Power Modulators and High Voltage Conference, http://ieeexplore.ieee.org/document/4743713/, May 27-31, 2008.

Liu et al., "Space Charge Behavior in Epoxy-Paper-Epoxy three Layers Composites", IEEE International Conference on High Voltage Engineering and Application (ICHVE) , http://ieeexplore.ieee.org/document/7800614/, Sep. 19-22, 2016.

* cited by examiner

TRANSFORMER AND AN ASSOCIATED METHOD THEREOF

STATEMENT REGARDING FEDERALLY SPONSORED RESEARCH & DEVELOPMENT

This invention was made with Government support under contract number DE-EE0007252 awarded by the Department of Energy. The Government has certain rights in the invention.

CROSS-REFERENCE TO RELATED APPLICATIONS

This patent application claims priority and benefit under 35 U.S.C. § 119(e) from U.S. Provisional Application No. 62/533,991 entitled "HIGH-FREQUENCY TRANSFORMER INSULATION IN MEDIUM-VOLTAGE, SIC-ENABLED SOLID STATE TRANSFORMERS," filed on Jul. 18, 2017, which is incorporated by reference herein in its entirety.

BACKGROUND

Embodiments of the present specification relate generally to a transformer in power converters, and more particularly to a system and method for insulating windings of the transformer.

In general, transformers are critical components in high voltage and high frequency power converters. Typically, a transformer includes primary and secondary windings wrapped around a core. The primary windings are electrically coupled to an alternating current (AC) power source and the secondary windings are electrically coupled to a load. During operation of a power converter, the transformer is constantly subjected to various electrical, mechanical, thermal, and environmental stresses. Such stresses tend to degrade the primary and secondary windings, consequently reducing life of the transformer.

In a high voltage and high frequency power converter, the transformer is configured to receive a high voltage signal (e.g., 8 kV) at the primary windings. Consequently, high voltage stresses are induced in the windings and may degrade the windings of the transformer.

In a conventional system, the transformer is immersed in dielectric oil or high-pressure gas to provide high voltage isolation between the primary windings and the secondary windings. However, a chamber provided with reliable seals and high voltage penetrators is required to enclose the dielectric oil or the high-pressure gas. The chamber provided with the dielectric oil or high-pressure gas may occupy more space in the transformer, thereby increasing the size of the transformer.

In another conventional system, a thick shielded coaxial cable is provided as an insulator for the primary windings and another thick shielded coaxial cable is provided as an insulator for the secondary windings. A cooling liquid flows inside these thick shielded coaxial cables to remove heat from the windings. However, the windings have a poor thermal conductivity due to the thick shielded coaxial cables. Also, the thick shielded coaxial cables occupy more volume and increase the size of the transformer.

BRIEF DESCRIPTION

In accordance with aspects of the present specification, a transformer is presented. The transformer includes a magnetic core having an opening. Also, the transformer includes a plurality of primary windings disposed extending through the opening of the magnetic core. Further, the transformer includes an insulation system including a first insulation substantially encapsulating the plurality of primary windings and impregnating spaces between the plurality of primary windings, and a second insulation disposed around the first insulation, where the second insulation has at least one of a predetermined dielectric strength and a predetermined thickness configured to isolate a first voltage signal in the plurality of primary windings from the magnetic core.

In accordance with another aspect of the present specification, a method for insulating windings of a transformer is presented. The method includes disposing a plurality of primary windings extending through an opening of a magnetic core of the transformer. Also, the method includes encapsulating, by a first insulation, the plurality of primary windings and impregnating spaces between the plurality of primary windings. Furthermore, the method includes disposing a second insulation around the first insulation, where the second insulation has at least one of a predetermined dielectric strength and a predetermined thickness configured to isolate a first voltage signal generated in the plurality of primary windings from the magnetic core during an operation of the transformer.

In accordance with yet another aspect of the present specification, a system is presented. The system includes a power source and an electric load. Further, the system includes a transformer electrically coupled between the power source and the electric load, where the transformer includes a magnetic core having an opening, a plurality of primary windings disposed extending through the opening of the magnetic core and electrically coupled to the power source to receive a first voltage signal. Further, the transformer includes an insulation system including a first insulation substantially encapsulating the plurality of primary windings and impregnating spaces between the plurality of primary windings, and a second insulation disposed around the first insulation, where the second insulation has at least one of a predetermined dielectric strength and a predetermined thickness configured to isolate the first voltage signal in the plurality of primary windings from the magnetic core.

DRAWINGS

These and other features, aspects, and advantages of the present disclosure will become better understood when the following detailed description is read regarding the accompanying drawings in which like characters represent like parts throughout the drawings, wherein.

DETAILED DESCRIPTION

As will be described in detail hereinafter, various embodiments of a system and a method for isolation of a high voltage generated in a transformer are presented. In addition to the isolation of high voltage, the exemplary system enhances thermal conductivity and also provides mechanical durability of the transformer. Moreover, the system aids in suppressing partial or surface discharges on windings of the transformer. As a result, degradation of the windings can be mitigated, which in-turn prevents failure of the transformer.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while considering that in some circumstances, the modified term may sometimes not be appropriate, capable, or suitable.

Figure 1:
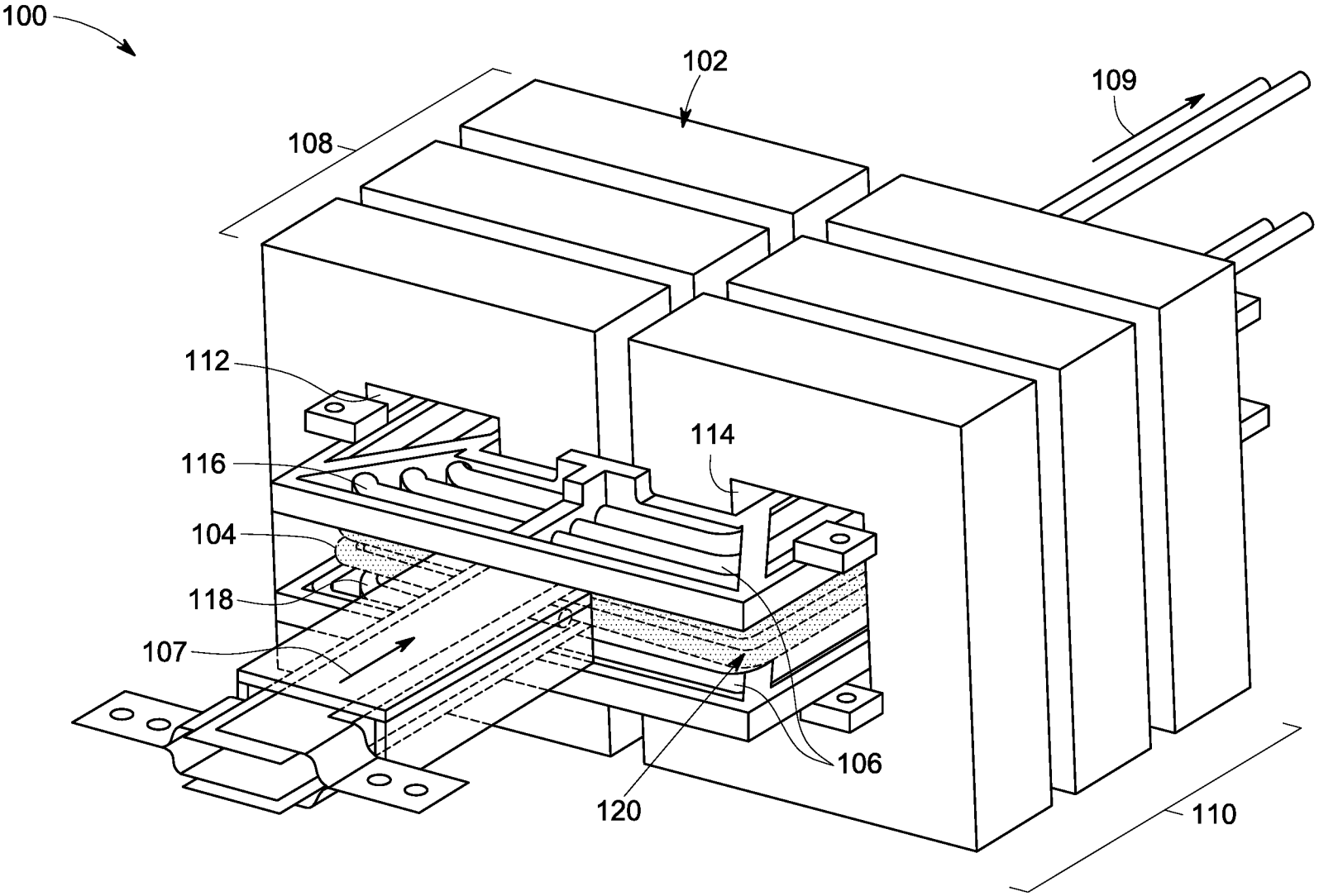
FIG. 1 is a perspective view of a transformer having an insulation system, in accordance with aspects of the present specification.

Turning now to the drawings and referring to FIG. 1, a perspective view of a transformer 100, in accordance with aspects of the present specification, is depicted. In one embodiment, the transformer 100 may be a high voltage transformer employed in a high voltage and high frequency power converter used in a wind turbine application or a solar energy application. In one example, the power converter may be a 13.8 kV 3-phase power converter system having a switching voltage of 1 kV (peak) and operating at a frequency of 200 kHz. It may be noted that the transformer 100 disclosed herein may be employed in other components/machines operating at any voltage and frequency.

In the illustrated embodiment, the transformer 100 includes a magnetic core 102, a plurality of primary windings 104, and a plurality of secondary windings 106. The magnetic core 102 includes one or more openings through which the primary windings 104 are extended through and wound around the magnetic core 102. In the embodiment of FIG. 1, the magnetic core 102 include a first core section 108 and a second core section 110 that are disposed adjacent to each other. Further, the first core section 108 includes a first opening 112 that extends through the first core section 108. Similarly, the second core section 110 includes a second opening 114 that extends through the second core section 110. In one embodiment, the first core section 108 and the second core section 110 may include multiple superposed laminated stacks made of metal such as, but not limited to, steel. It may be noted that the magnetic core 102 may have any configuration, and is not limited to the configuration shown in FIG. 1.

Further, the plurality of primary windings 104 is disposed extending through the first and second openings 112, 114 of the magnetic core 102. In particular, the plurality of primary windings 104 extends through the first opening 112 and the second opening 114 and is wound around the first core section 108 and the second core section 110. Also, the plurality of primary windings 104 is located in the middle of the first core section 108 and the second core section 110 of the magnetic core 102 as depicted in FIG. 1.

In a similar manner, the plurality of secondary windings 106 is disposed extending through the first and second openings 112, 114 of the magnetic core 102. More specifically, the plurality of secondary windings 106 includes a first set of secondary windings 116 and a second set of secondary windings 118. Further, the first set of secondary windings 116 is positioned above the plurality of primary windings 104, and the second set of secondary windings 118 is positioned below the plurality of primary windings 104. The first and second sets of secondary windings 116, 118 extend through the first opening 112 and the second opening 114 and are wound around the first core section 108 and the second core section 110.

In one embodiment, each winding of the plurality of primary windings 104 and the plurality of secondary windings 106 is a conductive material winding that is wound spirally around the first core section 108 and the second core section 110. In one example, the conductive material winding may be a copper wire with a coating of varnish or another synthetic coating. In a non-limiting example, number of turns of the plurality of primary windings 104 and the plurality of secondary windings 106 may vary depending upon the application of the transformer 100. In one example, the primary and second windings 104, 106 may be high frequency conductors, such as Litz wires.

Furthermore, the plurality of primary windings 104 is electrically coupled to an alternating current (AC) power source (not shown) and the plurality of secondary windings 106 is electrically coupled to a load (not shown). Also, the plurality of primary and secondary windings 104, 106 are inductively coupled to each other. The transformer 100 may increase or decrease the voltage generated by the AC power source based on a ratio of the number of turns of the plurality of primary windings 104 and the number of turns of the plurality of secondary windings 106. In the illustrated embodiment, during operation of the transformer 100, the plurality of primary windings 104 receives a high voltage signal 107 from the AC power source. In one example, the high voltage signal 107 may be in a range from about 7000 V to about 14000 V.

Further, the plurality of secondary windings 106 is inductively coupled to the plurality of primary windings 104 to receive a low voltage signal 109 from the plurality of primary windings 104 and transfer the low voltage signal 109 to the load. In one example, the low voltage signal 109 may be in a range from about 0 V to about 500 V. It may be noted that the terms "high voltage signal" and "first voltage signal" may be used interchangeably. Similarly, the terms "low voltage signal" and "second voltage signal" may be used interchangeably.

While operating a power converter, a transformer is constantly subjected to various electrical, mechanical, thermal, and environmental stresses. Such stresses tend to degrade primary and secondary windings, consequently reducing a life of the transformer. Also, in a high voltage and high frequency power converter, a transformer may be subjected to a high voltage (e.g., 8 KV) at the primary windings and a low voltage (e.g., 200 V) at the secondary windings. Consequently, high voltage stresses are induced on the primary and secondary windings resulting in degradation of the primary and secondary windings of the transformer.

To protect the windings from such stresses, the exemplary transformer 100 includes an insulation system 120 that provides a high voltage isolation between the plurality of primary windings 104 and the plurality of secondary windings 106 and also between the plurality of primary windings 104 and the magnetic core 102. The high voltage isolation provided by the insulation system 120 is configured to restrict transmission of the high voltage signal from the plurality of primary windings 104 to the plurality of secondary windings 106 or the magnetic core 102 so that stresses are not induced in the secondary windings 106 or the magnetic core 102.

Figure 2:
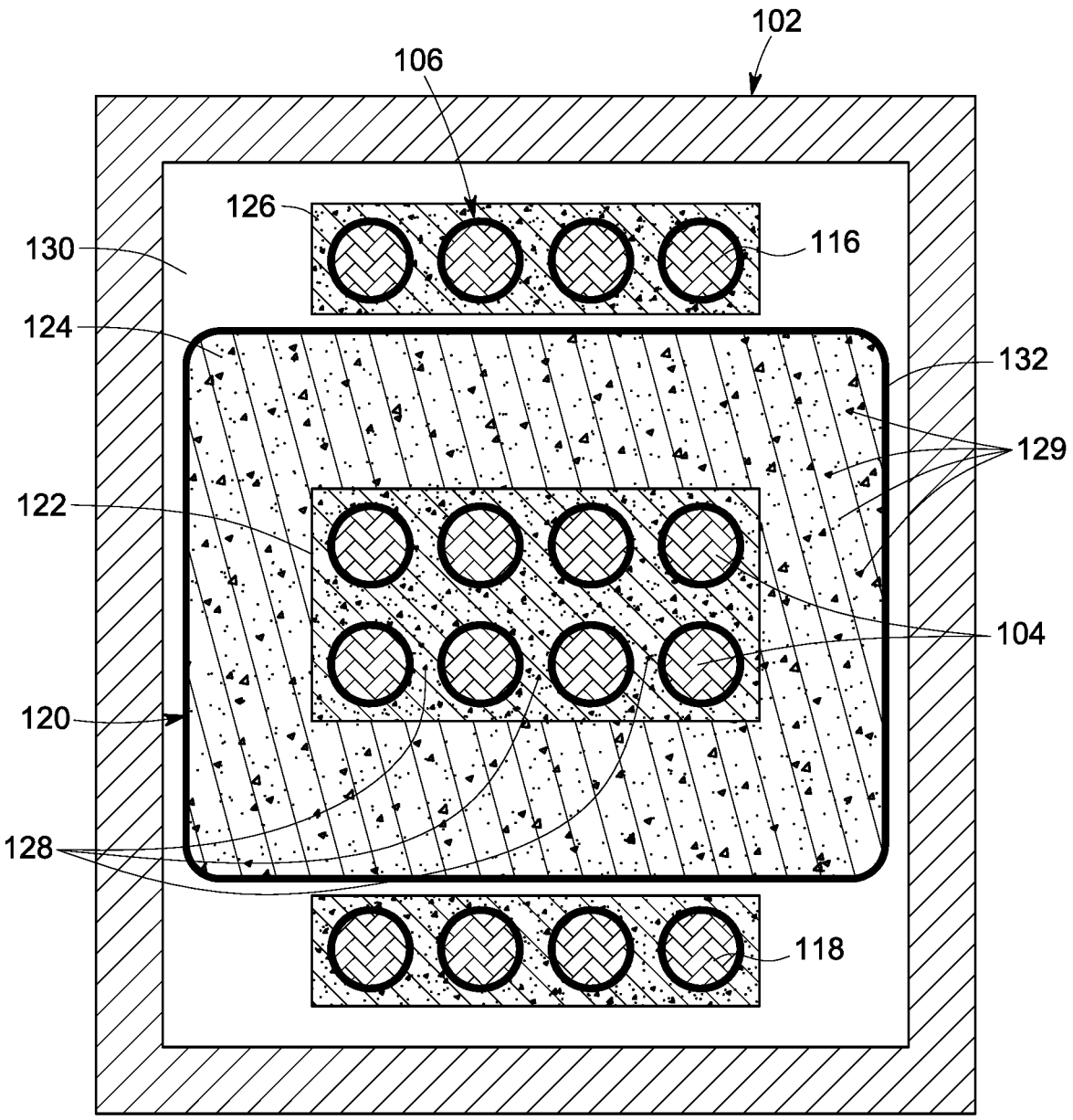
FIG. 2 is a cross-sectional view of the transformer of FIG. 1 illustrating a plurality of insulations of the insulation system, in accordance with aspects of the present specification.

Referring now to FIG. 2, a cross sectional view 200 of the transformer 100 of FIG. 1 is depicted. FIG. 2 is described with reference to the components of FIG. 1. The transformer 200 includes the insulation system 120. In the present example, the insulation system 120 is depicted as having a first insulation 122, a second insulation 124, and a third insulation 126. The first insulation 122 and the second insulation 124 are used as a double-layered insulation for the primary windings 104. The first insulation 122 is used to substantially encapsulate the primary windings 104 and impregnate spaces formed between the plurality of primary windings 104. In one non-limiting example, the first insulation 122 may encapsulate the plurality of primary windings 104 in a range from about 80% to about 100% of a surface of the plurality of primary windings 104.

Typically, a plurality of primary windings, such as Litz wires may have voids or spaces formed between and around the plurality of primary windings. Formation of such spaces or voids may result in generation of partial electrical discharge on the plurality of primary windings when a high voltage signal is transmitted to the plurality of primary windings. Consequently, the partial electrical discharge may erode the plurality of primary windings and may damage the transformer. It may be noted the partial electrical discharge is defined as an electrical discharge that occurs due to electric, breakdown of air within the spaces or voids.

To overcome the above-mentioned problem/drawbacks with the currently available insulation systems, in accordance with aspects of the present specification, the first insulation 122 includes a low viscosity material that impregnates the spaces formed between the plurality of primary windings 104. As a result, the voids or spaces between the plurality of primary windings 104 are eliminated, thereby preventing the partial electrical discharge on the plurality of primary windings 104. Also, the first insulation 122 forms a smooth outer surface on the plurality of primary windings 104. Further, the first insulation 122 forms a regular/annular shape around the plurality of primary windings 104. In one example, the first insulation 122 includes a polymer matrix including silicone, polyurethane, or a combination thereof. It may be noted that the first insulation 122 may also be referred as a turn insulation. In one example, the first insulation 122 has a thickness in a range from about 1 mm to about 5 mm. It may be noted that the thickness of the first insulation 122 is selected to reduce the overall cost and size of the transformer 100.

Additionally, the first insulation 122 includes one or more thermally conductive fillers 128. In one embodiment, the first voltage signal in the plurality of primary windings 104 may cause winding losses, which in-turn generate heat in the plurality of primary windings 104. The winding losses may also occur due to heating effect of an electric current flowing through the plurality of primary windings 104. In accordance with the illustrated embodiment, the thermally conductive fillers 128 of the first insulation 122 aid in effectively dissipating the heat from the plurality of primary windings 104. In one example, the thermally conductive fillers 128 include silica, boron nitride, alumina, or combinations thereof. Further, in one example, the thermal conductivity of the first insulation 122 is greater than 1 watt per meter-kelvin (W/m·k). In accordance with the illustrated embodiment, the first insulation 122 prevents the partial electrical discharge on the plurality of primary windings 104 and also provides good thermal conductivity to the plurality of primary windings 104.

Further, the second insulation 124 is disposed around the first insulation 122. The second insulation 124 is referred to as a main insulation that is used to provide a high voltage isolation between the plurality of primary windings 104 and the plurality of secondary windings 106 and also between the plurality of primary windings 104 and the magnetic core 102. More specifically, the second insulation 124 has at least one of a predetermined dielectric strength and a predetermined thickness configured to isolate the first voltage signal in the plurality of primary windings 104 from the magnetic core 102 and the plurality of secondary windings 106. The predetermined dielectric strength and the predetermined thickness of the second insulation 124 are designed so as to confine an electric field associated with the first voltage signal within the plurality of primary windings 104. Consequently, the first voltage signal in the plurality of primary windings 104 is isolated or restricted from being transmitted to the plurality of secondary windings 106 or the magnetic core 102. Such an isolation of the transmission of the first voltage signal prevents damage of the plurality of secondary windings 106 and the magnetic core 102. In one example, the predetermined dielectric strength of the second insulation 124 may be greater than 30 kV/mm. In another example, the predetermined thickness of the second insulation 124 may be in a range from about 5 mm to about 10 mm. It may be noted that the predetermined thickness of the second insulation 124 may be representative of a minimum thickness that is required to prevent electric breakdown of the second insulation 124.

In one embodiment, the second insulation 124 may include a polymer composite loaded with organic particles that is molded or casted around the first insulation 122 to increase mechanical toughness of the plurality of primary windings 104. The polymer composite with loaded organic particles provides the predetermined dielectric strength and high thermal conductivity to the plurality of primary windings 104. In one example, the second insulation 124 includes a polymer matrix including epoxy, polymethyl methacrylate (PMMA), polyester, polypropylene, polytetrafluoroethylene (PTFE), or combinations thereof. In another example, the second insulation 124 includes one or more thermally conductive fillers 129 such as quartz, fused silica, alumina, zinc oxides, titanium carbides, boron nitride, ferrite, or combinations thereof. In one embodiment, a quantity of the thermally conductive filler in the second insulation 124 is in a range from about 50×'© to about 70% of total quantity of material used in the second insulation 124. In addition, the thermal conductivity of the second insulation 124 may be greater than 0.8 watt per meter-kelvin (W/m·k). It may be noted that the thickness of the second insulation 124 is selected to reduce the overall cost and size of the transformer 100.

The third insulation 126 is used to substantially encapsulate the plurality of secondary windings 106 and impregnate spaces formed between the plurality of secondary windings 106. More specifically, the third insulation 126 includes a low viscosity material that impregnates the spaces formed between the plurality of secondary windings 106. As a result, the void or spaces between the plurality of secondary windings 106 are eliminated. Also, the third insulation 126 is used to isolate a second voltage signal in the plurality of secondary windings 106 from the magnetic core 102 and the plurality of primary windings 104. In particular, the third insulation 126 has a predetermined dielectric strength and a predetermined thickness that aid in isolating the transmission of the second voltage signal in the secondary windings 106 to the magnetic core 102 and the plurality of primary windings 104. In one example, the predetermined thickness of the third insulation 126 may be in a range from about 1 mm to about 5 min. In one embodiment, the third insulation 126 includes a thermally conductive filler such as silica, boron nitride, and alumina.

Furthermore, since the transformer 100 is operating at a high voltage and a high frequency, an average electric field generated at the second insulation 124 may be high. Such an electric field may cause localized electric discharge in an air space 130 formed between the second insulation 124 and the magnetic core 102. Consequently, an electric stress may be induced on the second insulation 124, which in-turn leads to faster deterioration of the second insulation 124.

To avoid the above-mentioned problem, the insulation system 120 includes an electric conductive layer 132 that is disposed around at least a portion of the second insulation 124 and configured to confine electric stress in the second insulation 124. In one example, a portion of the second insulation 124 that is proximate to the magnetic core 102 and the plurality of secondary windings 106 is covered by the electric conductive layer 132. In another example, the electric conductive layer 132 may be a conductive coating formed around the second insulation 124 to prevent localized electric discharges in the air space 130. More specifically, the electric conductive layer 132 around the second insulation 124 is connected to a ground potential to confine all the electric field within the second insulation 124, and thereby prevent leakage of the electric field into the air space 130. In one example, the electric conductive layer 132 includes at least one of a nickel coating and a metal enclosure.

In addition to the first insulation 122, the second insulation 124, the third insulation 126, and the electric conductive layer 132, the insulation system 120 further includes stress grading layers and a barrier, which will be described in detail with reference to FIGS. 3 and 4.

Thus, by employing the exemplary insulation system 120, high voltage isolation is provided between the plurality of primary windings 104 and the plurality of secondary windings 106 and also between the plurality of primary windings 104 and the magnetic core 102. Also, the insulation system 120 provides good thermal conductivity to dissipate the heat generated in the plurality of primary and secondary windings 104, 106. Moreover, by employing a double-layer insulation around the plurality of primary windings 104, overall thickness of the first and second insulations 122, 124 is substantially reduced, which in-turn reduces the overall footprint of the transformer 100.

Figure 3:
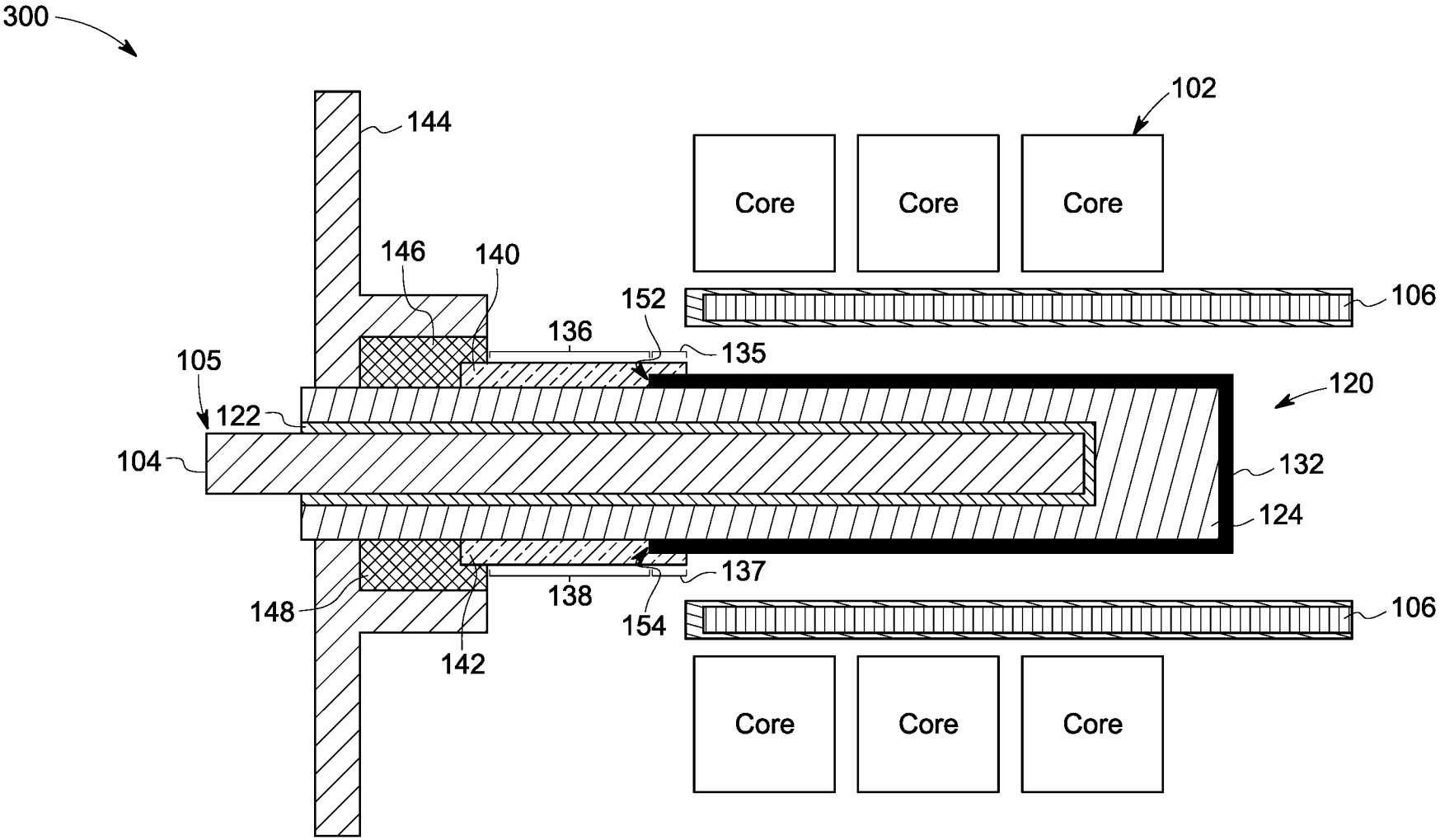
FIG. 3 is a side sectional view of the transformer of FIG. 1, in accordance with aspects of the present specification.

Turning to FIG. 3, a side sectional view 300 of the transformer 100 of FIG. 1, in accordance with aspects of the present specification, is depicted. FIG. 3 is described with reference to the components of FIGS. 1-2.

The electric conductive layer 132 is disposed around a portion of the second insulation 124 that is proximate to the plurality of secondary windings 106 and the magnetic core 102. Partial electrical discharge can occur at first and second uncovered portions 136, 138 of the second insulation 124 that are located distally from the secondary windings 106.

The insulation system 120 includes a first stress grading layer 140 and a second stress grading layer 142 that are respectively coupled to a first end 152 and a second end 154 of the electric conductive layer 132. As depicted in FIG. 3, the first stress grading layer 140 has a portion 135 overlapping the electric conductive layer 132 that is used to shield the first uncovered portion 136 of the second insulation 124 from an electric field associated with the first voltage signal, which in-turn prevents the partial electrical discharge at the first uncovered portion 136 of the second insulation 124. Similarly, the second stress grading layer 142 has a portion 137 overlapping the electric conductive layer 132 that is used to shield at least a second uncovered portion 138 of the second insulation 124 from the electric field associated with the first voltage signal, which in-turn prevents the partial electrical discharge at the second uncovered portion 138 of the second insulation 124. In one example, the first stress grading layer 140 and the second stress grading layer 142 may be provided with a silicon carbide coating.

Furthermore, a barrier 44 is coupled to the first stress grading layer 140 and the second stress grading layer 142. In one example, the barrier 144 may include fiberglass reinforced thermoset polyester material, such as GPO-3. The barrier 144 is configured to prevent a surface flashover on the primary and secondary windings 104, 106. The surface flashover is generally defined as an electric discharge phenomenon that develops on interfaces between adjacent dielectrics or insulations leaving conducting traces that cause further degradation of surface dielectric strength. In one example, the barrier 144 includes a first barrier joint 146 and a second barrier joint 148. The first barrier joint 146 has a portion that overlaps and is coupled to the first stress grading layer 140 to prevent a surface flashover at an interface between the second insulation 124 and the electric conductive layer 132.

Similarly, the second barrier joint 148 has a portion that overlaps and is coupled to the second stress grading layer 142 to prevent a surface flashover at the interface between the second insulation 124 and the electric conductive layer 132. Also, the barrier 144 is configured to provide clearance between terminals 105 of the plurality of primary windings 104 and the magnetic core 102 in accordance with industry standards such as IEC 61936-1. In one embodiment, the barrier 144 is coupled to a bushing provided to the plurality of primary windings 104 and the plurality of secondary windings 106.

Figure 4:
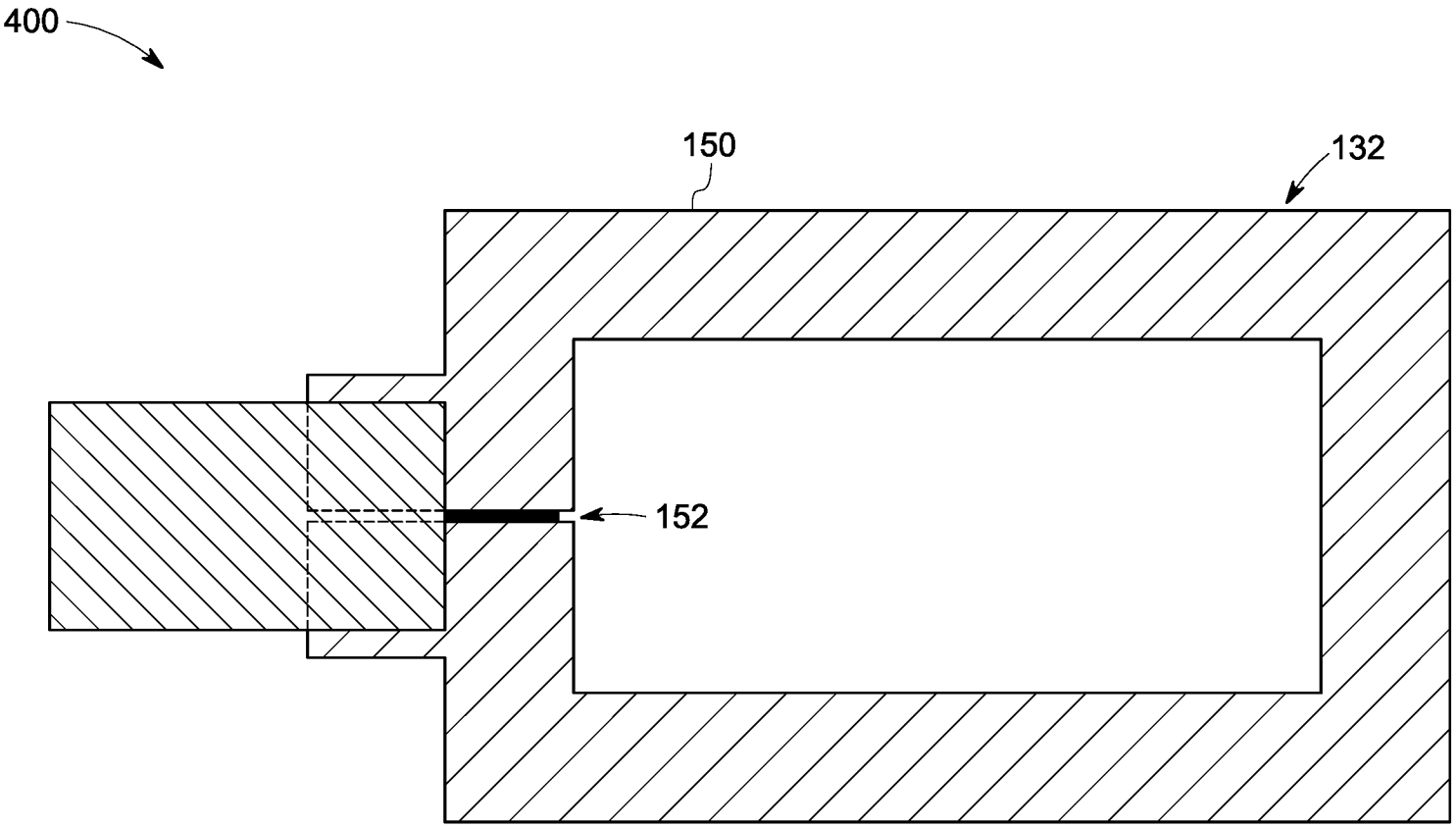
FIG. 4 is a top sectional view of an electric conductive layer of the insulation system, in accordance with aspects of the present specification.

Referring to FIG. 4, a top sectional view 400 of the electric conductive layer 132 of FIG. 3, in accordance with aspects of the present specification, is depicted. FIG. 4 is described with reference to the components of FIGS. 1-3.

The electric conductive layer 132 is formed as a non-continuous loop 150 having an opening 152 (for example, a narrow slot) located distally from the magnetic core 102 and the plurality of secondary windings 106. More specifically, the opening 152 is formed in the electric conductive layer 132 at a distal location from the magnetic core 102 and the plurality of secondary windings 106 to prevent shorting of the electric conductive layer 132. In one example, the opening 152 may have a width less than or equal to 1 mm. In another embodiment, two narrow openings (slots) (not shown), such a first narrow opening and a second narrow opening can be formed in the electric conductive layer 132. The first narrow opening may be located at a distal location from the magnetic core 102 and the second narrow opening may be located proximate to the magnetic core 102 and opposite to the first narrow Opening.

FIGS. 5-10 illustrate schematic representations of a fabrication method of a double-layered insulation of the plurality of primary windings 104, in accordance with aspects of the present specification. FIGS. 5-10 are described with reference to the components of FIGS. 1-4.

Figure 5:
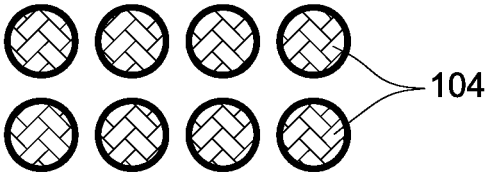
FIGS. 5-10 illustrate schematic representations of a fabrication method of a double-layered insulation of a plurality of primary windings of the transformer of FIG. 1, in accordance with aspects of the present specification.
Figure 6:
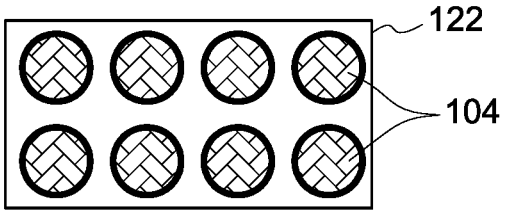
Figure 7:
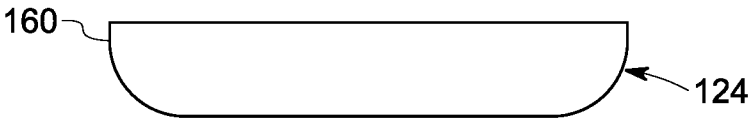

FIG. 5 depicts a bundle of Litz wires that is used as the plurality of primary windings 104. In one example, each of the plurality of primary windings 104 may have a thickness of about 50 microns. Further, FIG. 6 depicts encapsulating the plurality of primary windings with the first insulation 122. The first insulation includes a low viscosity material that impregnates through the spaces formed between the plurality of primary windings 104. Also, a lower half 160 of the second insulation 124 is molded or casted, as depicted in FIG. 7.

Figure 8:
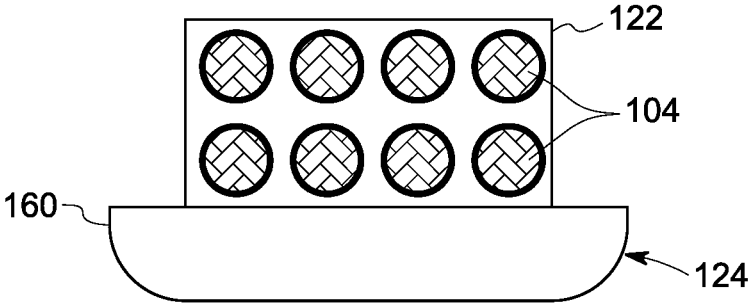
Figure 9:
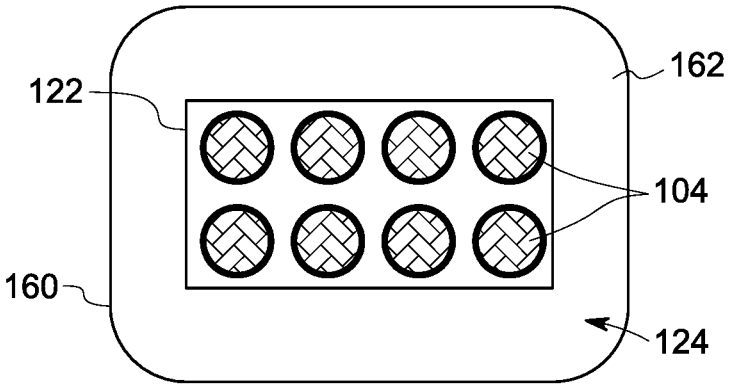
Figure 10:
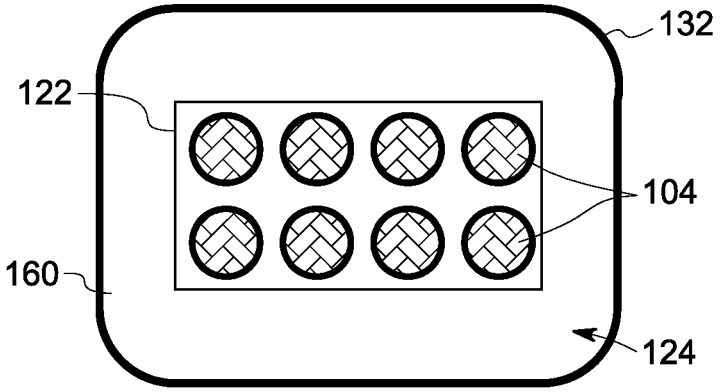

Thereafter, the first insulation 122 and the plurality of primary windings 104, are positioned on the lower half 160 of the second insulation 124, as depicted in FIG. 8. Furthermore, an upper half 162 of the second insulation 124 is molded or casted and coupled to the lower half 160 of the second insulation 124, as depicted in FIG. 9. In one embodiment, the second insulation 124 includes a polymer composite loaded with organic particles that is molded or casted around the first insulation 122 to provide mechanical toughness of the plurality of primary windings 104. Furthermore, an electric conductive layer 132 is created by applying a conductive paint around the second insulation 124, as depicted in FIG. 10. Thus, the fabrication method shown in FIGS. 5-10 leads to the formation of the insulation system 120.

Figure 11:
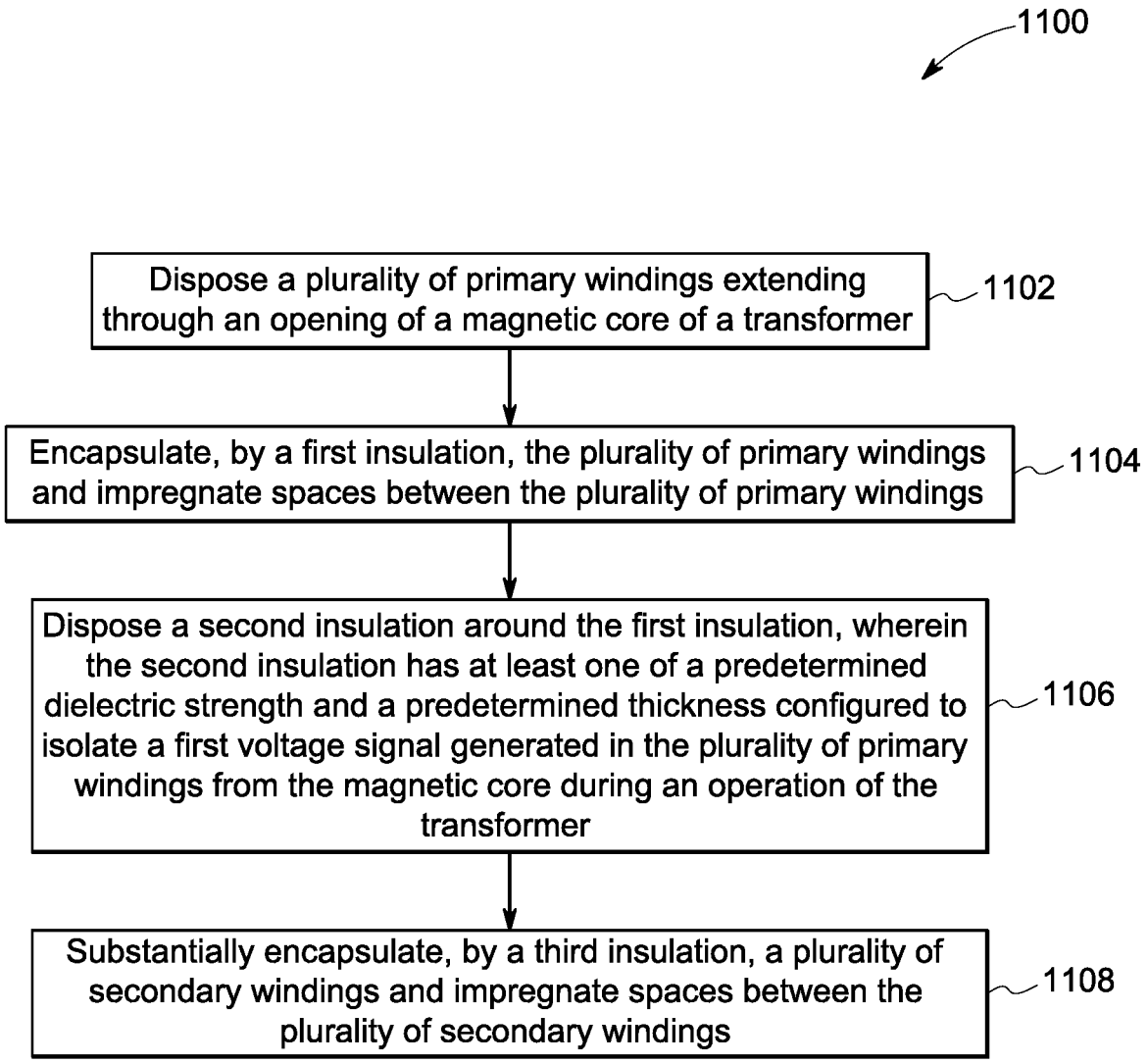
FIG. 11 is a flow chart illustrating a method for providing insulation to the plurality of primary windings and a plurality of secondary windings in the transformer of FIG. 1, in accordance with aspects of the present specification.

Referring to FIG. 11, a flow chart illustrating a method for providing insulation to windings in a transformer, in accordance with aspects of the present specification, is depicted. For ease of understanding, the method is described with reference to the components of FIGS. 1-4. At step 1102, a plurality of primary windings 104 is disposed and extended through an opening of a magnetic core 102 of a transformer 100. The opening may include a first opening 112 and a second opening 114. In particular, the plurality of primary windings 104 extends through the first opening 112 and the second opening 114 and is wound around the first core section 108 and the second core section 110. Also, the plurality of primary windings 104 is located in the middle of the first core section 108 and the second core section 110 of the magnetic core 102 as depicted in FIG. 1.

Moreover, at step 1104, the plurality of primary windings 104 is encapsulated by a first insulation 122. Also, the first insulation 122 may impregnate spaces between the plurality of primary windings 104. In particular, the first insulation 122 includes a low viscosity material that impregnates the spaces formed between the plurality of primary windings 104. As a result, the voids or spaces between the plurality of primary windings 104 are eliminated, thereby preventing partial electrical discharge on the plurality of primary windings 104. Also, the first insulation 122 forms a smooth outer surface on the plurality of primary windings 104.

Furthermore, at step 1106, a second insulation 124 is disposed around the first insulation 122. The second insulation 124 has at least one of a predetermined dielectric strength and a predetermined thickness configured to isolate a first voltage signal generated in the plurality of primary windings 104 from the magnetic core 102 during an operation of the transformer 100. In particular, the predetermined dielectric strength and the predetermined thickness of the second insulation 124 are designed so as to confine an electric field associated with the first voltage signal within the plurality of primary windings 104. Consequently, the first voltage signal in the plurality of primary windings 104 is isolated or restricted from being transmitted to the plurality of secondary windings 106 or the magnetic core 102. Such an isolation of the transmission of the first voltage signal prevents damage of the plurality of secondary windings 106 and the magnetic core 102. In one example, the predetermined dielectric strength of the second insulation 124 may be greater than 30 kV/mm. In another example, the predetermined thickness of the second insulation 124 may be in a range from about 5 mm to about 10 mm.

Additionally or optionally, at step 1108, a third insulation 126 may be disposed to substantially encapsulate the plurality of secondary windings 106 and impregnate spaces formed between the plurality of secondary windings 106. More specifically, the third insulation 126 includes a low viscosity material that impregnates the spaces formed between the plurality of secondary windings 106. As a result, the void or spaces between the plurality of secondary windings 106 are eliminated. Also, the third insulation 126 is used to isolate the second voltage signal in the plurality of secondary windings 106 from the magnetic core 102 and the plurality of primary windings 104.

Figure 12:
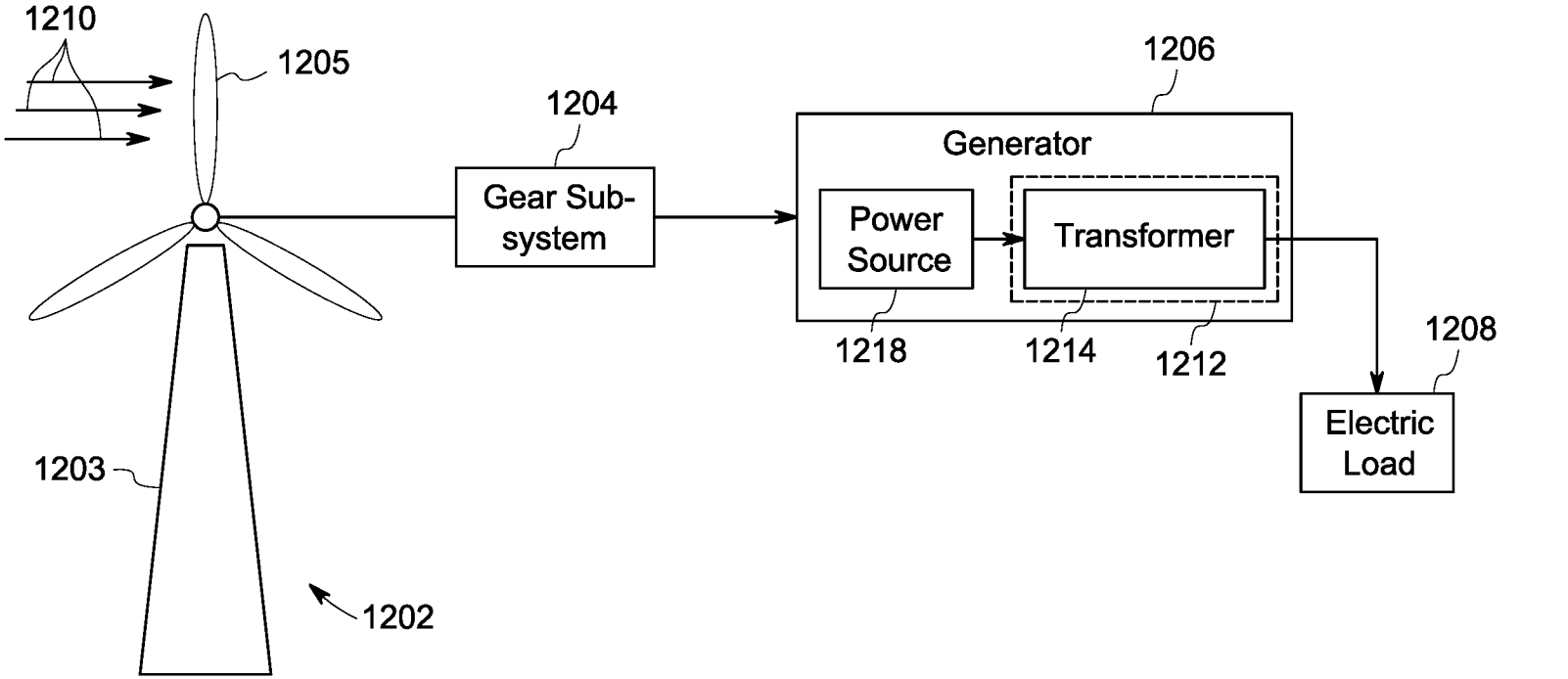
FIG. 12 is a diagrammatical representation of a wind turbine system having the transformer of FIG. 1, in accordance with aspects of the present specification.

Referring to FIG. 12, a diagrammatical representation of a system 1200 having a transformer, in accordance with aspects of the present specification is depicted. The transformer may be representative of the transformer 100 of FIG. 1. The system 1200 may be a wind turbine system or a solar energy system. For ease of illustration, the system 1200 of FIG. 12 depicts a wind turbine system. It may be noted that the transformer 100 of FIG. 1 may be used in various other applications, and is not limited to a wind turbine application or a solar energy application.

As depicted in FIG. 12, the wind turbine system 1200 includes a wind turbine 1202, a gear sub-system 1204, a generator 1206, and an electric load 1208. The wind turbine 1202 is coupled to the gear sub-system 1204, which in-turn is coupled to the generator 1206. Further, the generator 1206 is coupled to the electric load 1208.

In one embodiment, the wind turbine 1202 includes a tower 1203 and a plurality of blades 1205. Moreover, the wind turbine 1202 is configured to convert wind energy into mechanical energy or rotational energy. For example, kinetic energy of wind 1210 passing across the blades 1205 of the wind turbine 1202 is converted into mechanical energy. This converted mechanical energy is used to rotate a shaft coupled between the gear sub-system 1204 and the generator 1206 to generate electrical energy or electric power by the generator 1206.

Furthermore, the generator 1206 includes a power converter 1212 having a transformer 1214 for changing a magnitude of the electric power and transferring this electric power to the electric load 1208. In the embodiment of FIG. 12, the transformer 1214 is electrically coupled to a power source 1218 and the electric load 1208. In one example, the electric load 1208 may be a power grid. The power source 1218 may be an AC power source. Moreover, in one example, the power source 1218 may be configured to store the electric power generated by the generator 1206.

As noted hereinabove, the transformer 1214 may be the transformer 100 of FIG. 1. The transformer 1214 includes a magnetic core, a plurality of primary windings, and a plurality of secondary windings. The plurality of primary windings is disposed and extended through an opening in the magnetic core. Also, the plurality of primary windings is electrically coupled to the power source 1218 to receive a first voltage signal from the power source 1218. In a similar manner, the plurality of secondary windings is disposed and extended through the opening of the magnetic core. Also, the plurality of secondary windings is electrically coupled to the electric load 1208 and inductively coupled to the plurality of primary windings to transfer a second voltage signal to the electric load 1208.

To protect the windings from various electrical, mechanical, thermal, and environmental stresses, the transformer 1214 includes an exemplary insulation system that provides a high voltage isolation between the plurality of primary windings and the plurality of secondary windings and also between the plurality of primary windings and the magnetic core. This insulation system may be the insulation system 120 of FIG. 1.

The insulation system includes a first insulation and a second insulation. The first insulation is used to substantially encapsulate the plurality of primary windings and impregnate spaces between the plurality of primary windings. Further, the second insulation is disposed around the first insulation. Also, the second insulation has a predetermined dielectric strength and a predetermined thickness, which aid in isolating the first voltage signal in the plurality of primary windings from the magnetic core and the plurality of secondary windings during operation of the transformer 1214.

In addition, the insulation system includes a third insulation that is used to substantially encapsulate the plurality of secondary windings and impregnate spaces between the plurality of secondary windings. Also, the third insulation is configured to isolate the second voltage signal in the plurality of secondary windings from the magnetic core and the plurality of primary windings during operation of the transformer 1214. The various embodiments presented hereinabove disclose exemplary systems and methods that aid in isolating a high voltage signal associated with the plurality of primary windings from the plurality of secondary windings and the magnetic core. Additionally, the exemplary system increases thermal conductivity and provides mechanical durability to the transformer. Moreover, the insulation system aids in suppressing surface discharges or partial electrical discharges on the plurality of primary and secondary windings. As a result, degradation of the windings may be prevented, which in-turn prevents failure of the transformer.

While only certain features of the present disclosure have been illustrated, and described herein, many modifications and changes will occur to those skilled in the art. It is, therefore, to be understood that the appended claims are intended to cover all such modifications and changes as fall within the true spirit of the present disclosure.

The invention claimed is:

1. A transformer comprising:

a magnetic core having an opening;

a plurality of primary windings disposed extending through the opening of the magnetic core;

a plurality of secondary windings disposed extending through the opening of the magnetic core; and an insulation system comprising:

a first insulation substantially encapsulating the plurality of primary windings and impregnating spaces between the plurality of primary windings; and a second insulation disposed around the first insulation, isolating a first voltage signal in the plurality of primary windings from the magnetic core and the plurality of secondary windings, wherein the second insulation has at least one of a predetermined dielectric strength and a predetermined thickness.

2. The transformer of claim 1, wherein the predetermined thickness of the second insulation is in a range from 5 mm to 10 mm.

3. The transformer of claim 1, wherein the predetermined dielectric strength of the second insulation is greater than 30 kV/mm.

4. The transformer of claim 1, wherein the first insulation comprises a polymer matrix comprising silicone, polyurethane, or a combination thereof.

5. The transformer of claim 4, wherein the first insulation further comprises a thermally conductive filler comprising silica, boron nitride, alumina, or combinations thereof.

6. The transformer of claim 5, wherein the first insulation has a thermal conductivity greater than 1 watt per meter-kelvin.

7. The transformer of claim 1, wherein the second insulation comprises a polymer matrix comprising epoxy, polymethyl methacrylate, polyester, polypropylene, polytetrafluoroethylene, or combinations thereof.

8. The transformer of claim 7, wherein the second insulation further comprises a thermally conductive filler comprising quartz, fused silica, alumina, zinc oxides, titanium carbides, boron nitride, ferrite, or a combination thereof.

9. The transformer of claim 8, wherein the second insulation has a thermal conductivity greater than 0.8 watt per meter-kelvin.

10. The transformer of claim 1, wherein the insulation system comprises a third insulation substantially encapsulating a plurality of secondary windings of the transformer and impregnating spaces between the plurality of secondary windings.

11. The transformer of claim 10, wherein the third insulation is configured to isolate a second voltage signal generated in the plurality of secondary windings from the magnetic core and the plurality of primary windings during operation of the transformer.

12. The transformer of claim 10, wherein the second insulation is configured to isolate the first voltage signal generated in the plurality of primary windings from the plurality of secondary windings during operation of the transformer.

13. The transformer of claim 1, wherein the insulation system further comprises an electric conductive layer disposed around at least a portion of the second insulation and configured to confine a generated electric stress in the second insulation during operation of the transformer.

14. The transformer of claim 13, wherein the electric conductive layer is formed as a non-continuous loop having an opening located distally from the magnetic core and the plurality of secondary windings.

15. The transformer of claim 13, wherein the insulation system further comprises:

a first stress grading layer having a portion disposed overlapping the electric conductive layer to shield at least a first uncovered portion of the second insulation from an electric field associated with the first voltage signal; and a second stress grading layer having a portion disposed overlapping the electric conductive layer to shield at least a second uncovered portion of the second insulation from the electric field associated with the first voltage signal.

16. The transformer of claim 15, further comprising a barrier coupled to the first stress grading layer and the second stress grading layer, wherein the barrier is configured to provide clearance between terminals of the plurality of primary windings and the magnetic core.

17. A system comprising:

a power source;

an electric load; and a transformer electrically coupled between the power source and the electric load, wherein the transformer comprises:

a magnetic core having an opening;

a plurality of primary windings disposed extending through the opening of the magnetic core and electrically coupled to the power source to receive a first voltage signal;

a plurality of secondary windings disposed extending through the opening of the magnetic core; and an insulation system comprising:

a first insulation substantially encapsulating the plurality of primary windings and impregnating spaces between the plurality of primary windings; and a second insulation disposed around the first insulation, isolating a first voltage signal in the plurality of primary windings from the magnetic core and the plurality of secondary windings, wherein the second insulation has at least one of a predetermined dielectric strength and a predetermined thickness.

18. The system of claim 17, wherein the insulation system comprises a third insulation substantially encapsulating a plurality of secondary windings of the transformer and impregnating spaces between the plurality of secondary windings, and wherein the third insulation is configured to isolate the second voltage signal generated in the plurality of secondary windings from the magnetic core and the plurality of primary windings during operation of the transformer.

19. The system of claim 17, wherein the system is a wind turbine system or a solar energy system.

20. A transformer comprising:

a magnetic core having an opening;

a plurality of primary windings disposed extending through the opening of the magnetic core; and an insulation system comprising:

a first insulation substantially encapsulating the plurality of primary windings and impregnating spaces between the plurality of primary windings;

a second insulation disposed around the first insulation, wherein the second insulation has at least one of a predetermined dielectric strength and a predetermined thickness configured to isolate a first voltage signal in the plurality of primary windings from the magnetic core; and a third insulation substantially encapsulating a plurality of secondary windings of the transformer and impregnating spaces between the plurality of secondary windings.

21. The transformer of claim 20, wherein the first insulation comprises a polymer matrix comprising silicone, polyurethane, or a combination thereof.

22. The transformer of claim 20, wherein the second insulation comprises a polymer matrix comprising epoxy, polymethyl methacrylate, polyester, polypropylene, polytetrafluoroethylene, or combinations thereof.

23. The transformer of claim 20, wherein the insulation system further comprises an electric conductive layer disposed around at least a portion of the second insulation and configured to confine a generated electric stress in the second insulation during operation of the transformer.

* * * * *